US008443908B2

(12) United States Patent
McHugh, IV

(10) Patent No.: US 8,443,908 B2
(45) Date of Patent: May 21, 2013

(54) CONDENSATE COLLECTOR ARRANGEMENT WITH ANTI-TRIP ARRANGEMENT FOR DRY PIPE SPRINKLER SYSTEM

(75) Inventor: George McHugh, IV, Malvern, PA (US)

(73) Assignee: AGF Manufacturing, Inc., Malvern, PA (US)

( * ) Notice: Subject to any disclaimer, the term of this patent is extended or adjusted under 35 U.S.C. 154(b) by 188 days.

(21) Appl. No.: 12/875,817

(22) Filed: Sep. 3, 2010

(65) Prior Publication Data

US 2012/0055686 A1 Mar. 8, 2012

(51) Int. Cl.
*A62C 35/00* (2006.01)

(52) U.S. Cl.
USPC ..... 169/17; 169/16

(58) Field of Classification Search
USPC ..... 169/17, 16, 5; 239/124, 126
See application file for complete search history.

(56) References Cited

U.S. PATENT DOCUMENTS

| | | | |
|---|---|---|---|
| 72,793 | A | 12/1867 | Bundy |
| 1,326,922 | A | 1/1920 | Ecks |
| 2,642,675 | A | 6/1953 | Hertenstein, Jr. |
| 3,329,215 | A | 7/1967 | Kane |
| 4,135,542 | A | 1/1979 | Chisholm |
| 4,353,387 | A | 10/1982 | Bouygues et al. |
| 4,849,739 | A | 7/1989 | Loiacono |
| 5,533,545 | A | 7/1996 | Robinson |
| 5,685,338 | A | 11/1997 | Trunk |
| 5,808,541 | A | 9/1998 | Golden |
| 6,102,066 | A | 8/2000 | Craig et al. |
| 6,104,301 | A | 8/2000 | Golden |
| 6,443,173 | B1 | 9/2002 | Thompson, Jr. |
| 6,540,028 | B2 | 4/2003 | Wood |
| 7,273,071 | B2 | 9/2007 | Marler et al. |
| 7,530,402 | B2 | 5/2009 | Cabral |
| 7,766,031 | B2 | 8/2010 | Platusich et al. |
| 2007/0151604 | A1 | 7/2007 | Platusich et al. |
| 2009/0020166 | A1 | 1/2009 | McHugh, IV |

OTHER PUBLICATIONS

Instructions for Drum Drip Assembly—Monitored, Aug. 2000, Afcon, So. El Monte, CA.

Mike Cabral, "Dry Pipe Valves—Water Cold—Freeze Protection," FPC/Fire Protection Contractor, Sep. 2006.

NFPA Reviews, NFPA 13, 2006, pp. 13-37 to 13-39, 13-58 and 13-85.

Never Trip Valve, 2007, Metraflex Co., Chicago, IL.

WCS Water Column Switch, Potter, The Symbol of Protection, Brochure, May 2008, pp. 1-3, Potter Electric Signal Co., LLC, St. Louis, MO.

Locking Plate Kits for TESTanDRAIN Valves, Mar. 2008, AGF Manufacturing, Inc.

Automatic Sprinkler Systems Handbook, NFPA 13, 2010, pp. 376-378.

NFPA, 2002, p. 25-64.

COLLECTanDRAIN Model 5100, Brochure, Oct. 2009, AGF Manufacturing, Inc.

COLLECTanDRAIN Model 5100/5200, Brochure, Jun. 2010, AGF Manufacturing, Inc.

Canadian Office Action issued in corresponding Canadian Application No. 2,715,784, dated Jan. 10, 2013, 3 pages.

*Primary Examiner* — Davis Hwu

(74) *Attorney, Agent, or Firm* — Buchanan Ingersoll & Rooney PC

(57) ABSTRACT

A condensate collector arrangement for a dry pipe sprinkler system comprises a collection chamber and an upstream valve and a downstream valve with an anti-trip arrangement for preventing the upstream valve and the downstream valve to be open at the same time and preferably includes an arrangement to indicate the presence of condensate and a lock for the anti-trip arrangement and an alarm which may be selectively deactivated.

23 Claims, 6 Drawing Sheets

CONDENSATE COLLECTOR ARRANGEMENT WITH ANTI-TRIP ARRANGEMENT FOR DRY PIPE SPRINKLER SYSTEM

FIELD OF INVENTION

The present invention relates to dry pipe sprinkler systems or preaction systems and in particular to a condensate collector arrangement for a dry pipe sprinkler system with an alarm.

BACKGROUND

A dry pipe sprinkler system or preaction system comprises a fire suppression system that is typically used in structures and areas that are oftentimes unheated and subject to freezing temperatures. The dry pipe sprinkler system includes a network of pipes including branch lines servicing sprinkler heads, risers, and feed mains for delivering water from a water supply to the branch lines. Under normal conditions, this network of pipes contains a pressurized gas, such as air or nitrogen, which holds closed a dry pipe valve that connects the main supply pipes of main feeds of the sprinkler system to the water supply. When heat from a fire opens a sprinkler, the compressed gas is released from the system. The resulting drop in pressure causes the dry pipe valve to open, or trip, thereby releasing water into the main supply lines or main feeds.

When the network of pipes is filled with the pressurized gas and the ambient temperature lowers, condensate can collect in the network of pipes. If the condensate builds up in the system, then there is a risk that the condensate will freeze in the pipes. Freezing condensate can cause pipes to leak or burst, or inhibit the flow of water through the branch lines in the event of fire. For this reason, dry pipe systems often include one or more condensate collector arrangements (sometimes called "drum drips") which collect condensate from the network of pipes. These drum drips are typically located at low points of the dry pipe system and usually include a drainage valve and a shut-off valve connecting the drum drip to a riser. A drum drip is drained of condensate by first closing the upper valve. This prevents pressurized gas from exiting the system when the drum drip is being drained. The drain valve is then opened and condensate is drained from the drum drip. Then the drain valve is closed again and the upper valve may be reopened to again allow condensate to be collected.

In the conventional condensate collector arrangements, the valve located upstream of the collected condensate is operated independently of the valve that is located downstream of the collected condensate. Accordingly, although the upstream valve should be closed before the downstream valve is opened to drain the collected condensate, it is possible in the conventional arrangements, whether inadvertently or not, for both the upstream valve and the downstream valve to be open at the same time. If this occurs, the dry pipe system may likely lose pressure and trip the fire protection system. Tripping the fire protection system would then likely fill the sprinkler system with water and may also trigger a false alarm indicative of a fire.

NFPA 13 and NFPA 25 requirements concern drainage of dry and preaction sprinkler systems and note that the upper valve is to be closed before the lower valve is opened when the system is charged. However, the valves may still be operated improperly with both valves open at the same time either accidentally or maliciously or due to tampering to trip the system.

Accordingly, the need exists for an arrangement which prevents the upstream valve and the downstream valve in a condensate collector from being fully open at the same time.

The need also exists for a condensate collector with an arrangement to physically prevent the upstream valve and the downstream valve from being fully open at the same time and to prevent the lower valve from being opened by an unauthorized individual.

When the condensate collector is provided in an environment that is subject to freezing temperatures, a need also exists for a condensate collector that indicates the presence of even a relatively small amount of condensate in the condensate collector and in which an alarm that indicates the presence of condensate may be selectively deactivated.

BRIEF SUMMARY

In a preferred embodiment, a condensate collector for a dry pipe sprinkler system comprises a first valve comprising an inlet and an outlet with the first valve selectively being open or closed. When open, the first valve permits communication between the inlet and the outlet of the first valve and when closed prevents communication between the inlet and the outlet of the first valve. A second valve comprises an inlet and an outlet, with the second valve selectively being open or closed. When open, the second valve permits communication between the inlet and the outlet of the second valve and when closed prevents communication between the inlet and the outlet of the second valve. A collection chamber is in fluid communication with the outlet of the first valve and the inlet of the second valve. An anti-trip arrangement physically prevents the first valve and the second valve from being fully open at the same time.

In another preferred embodiment, the anti-trip arrangement mechanically links the first valve and the second valve to prevent the first valve and the second valve from being fully open at the same time. The anti-trip arrangement preferably comprises a plate member which is movable to a first position wherein the first valve may be fully open and the second valve must be closed.

In another preferred embodiment, the anti-trip arrangement comprises a plate member which is movable between a first position wherein the first valve may be fully open and the second valve must be closed and a second position wherein the second valve may be fully open and the first valve must be closed.

Preferably, the first valve comprises a first valve actuator which is moveable between a first position wherein the first valve is fully open and a second position wherein the first valve is fully closed. The second valve comprises a second valve actuator moveable between a first position wherein the second valve is fully open and a second position wherein the second valve is fully closed. The anti-trip arrangement prevents movement of the second valve actuator to the first position to fully open the second valve when the first valve actuator is in the first position.

Preferably, the anti-trip arrangement prevents movement of the first valve actuator to the first position to fully open the first valve when the second valve actuator is in the first position. The plate member comprises a first valve abutment portion which prevents movement of the first valve actuator to the first position when the plate is in the second position and wherein the plate member comprises a second valve abutment portion which prevents movement of the second valve actuator to the first position when the plate is in the first position.

In a preferred embodiment, the first valve abutment portion prevents the plate from moving to the second position when the first valve actuator is in the first position and the second valve abutment portion prevents the plate from moving to the first position when the second valve actuator is in the first position.

In a preferred embodiment, the collection chamber is generally elongate between the first valve and the second valve and the collection chamber is generally cylindrical. The first valve member and the second valve member are generally aligned with one another with the collection chamber extending longitudinally between the first valve member and the second valve member. Preferably, the plate is carried by the collection chamber for movement between the first and second positions and the plate is also carried by the first and second valves for movement between the first and second positions.

Preferably, a lock is provided to engage the plate to prevent movement of the plate from the first position to the second position when the lock engages the plate. A bracket preferably is provided having an opening to selectively receive the lock when the plate is in the first position. The bracket and the lock together prevent movement of the plate to the second position independent of whether the first valve is open or closed.

In a preferred embodiment, the plate comprises a middle section provided between the first valve abutment portion and the second valve abutment portion. The middle section is generally planar with at least one slot which limits movement of the plate to movement between the first position and the second position. The first and second valve abutment portions extend generally perpendicular to the middle section of the plate. The plate further comprises a first end portion which is slidably received by the first valve and a second end portion which is slidably received by the second valve. The first end portion extends generally perpendicular to the first abutment portion and the second end portion extends generally perpendicular to the second abutment portion.

Preferably, the inlet of the second valve member further comprises at least one side port, with the inlet and outlet of the first valve and the inlet and outlet of the second valve being generally collinear. The inlet of the second valve member further comprises first and second side ports provided generally perpendicular to a longitudinal axis of the second valve. The first and second side ports are generally collinear and are provided on opposite sides of the second valve. In a preferred embodiment, a detector such as a sensor or a float mechanism is in fluid communication with the collection chamber through a side port of the second valve to detect the presence of a predetermined amount of liquid in the condensate collector adjacent the second valve.

In another preferred embodiment, the first valve further comprises a first valve actuator and the second valve further comprises a second valve actuator. The first valve actuator comprises a first axis of rotation and the second valve actuator comprises a second axis of rotation. The first axis of rotation and the second axis of rotation are oriented in the same general direction with respect to the collection chamber. In a preferred embodiment, the axis of rotation are set apart by a predetermined distance.

In another preferred embodiment, an alarm is provided to indicate the presence of a predetermined amount of liquid or water in the condensate collector. Preferably, the alarm indicates the presence of a predetermined amount of liquid in the condensate collector adjacent the second valve. The alarm may have a switch to selectively disable the alarm.

In another preferred embodiment, an arrangement is provided for detecting the presence of at least a predetermined amount of water in the condensate collector, with the arrangement being configured to provide a signal at an auxiliary indicator panel or a fire alarm panel provided at a location remote from the condensate collector.

Preferably, a lock is provided to engage the plate to prevent movement of the plate from the first position to the second position when the lock engages the plate. A bracket preferably is provided having an opening to selectively receive the lock when the plate is in the first position. The bracket and the lock together prevent movement of the plate to the second position independent of whether the first valve is open or closed.

These and other aspects of the present invention will become apparent to those skilled in the art after a reading of the following description of the preferred embodiment when considered with the drawings.

DETAILED DESCRIPTION OF PREFERRED EMBODIMENTS

Figure 1:
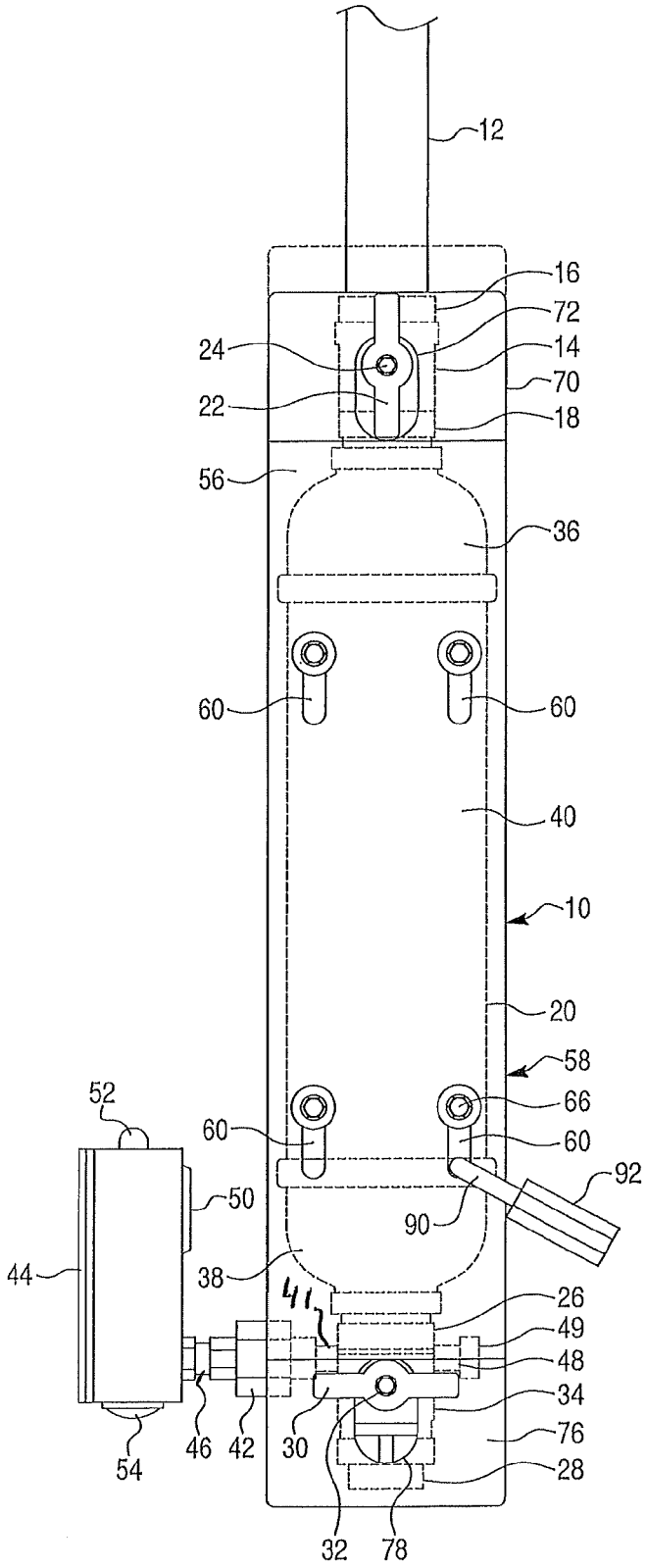
FIG. 1 is a front view of a condensate collector arrangement with an anti-trip arrangement in a first position according to a preferred embodiment.

A dry pipe sprinkler system typically includes a network of pipes which are in fluid communication with sprinkler heads (not shown). The network of pipes is filled with a pressurized gas, e.g., air or nitrogen. With reference to FIG. 1, a condensate collector arrangement or drum drip 10 is preferably located at a low point in the dry pipe system and is connected to the network of pipes through a fitting 12. A condensate collector arrangement for a dry pipe sprinkler system is described in Assignee's Published Patent Application No. US 2009/0020166 dated Jan. 22, 2009 and is hereby incorporated by reference.

The condensate collector 10 comprises a first valve 14 which is provided at an upper portion of the condensate collector 10 and a second valve 34 which is provided at a lower portion of the condensate collector 10. The first or upper valve 14 comprises an inlet 16 which communicates with the network of pipes of the dry pipe system through the fitting 12. The first valve 14 also comprises an outlet 18 which communicates with a condensate collector chamber 20 when the first valve is open.

The first valve 14 has a valve actuator 22 such as a "TEE handle" which is arranged to rotate about an axis 24. In the preferred embodiment, the valve actuator 22 extends a predetermined distance from the axis 24. The first valve 14 preferably is a quarter-turn valve with the valve fully open when the valve actuator 22 is aligned with a longitudinal axis of the first valve from the inlet 16 to the outlet 18 and with the valve fully closed when the valve actuator has been rotated 90° to position the valve actuator generally perpendicular to the longitudinal axis of the first valve 14.

The second valve 34 similarly has an inlet 26 in communication with the condensate collection chamber 20 and an outlet 28. The second valve 34 closes the condensate collection chamber when the second valve 34 is closed and the second valve 34 permits the condensate collection chamber to be drained or emptied when the second valve is open by permitting communication between the inlet 26 and the outlet 28 of the second valve 34. The second valve 34, like the first valve 14, has a valve actuator 30 such as a "TEE handle" which is arranged to rotate about an axis 32. In the preferred embodiment, the valve actuator 30 extends a predetermined distance from the axis 32. The second valve 34 preferably is a quarter-turn valve with the valve fully open when the valve actuator 30 is aligned with a longitudinal axis of the second valve from the inlet 26 to the outlet 28 and with the valve fully closed when the valve actuator has been rotated 90° to position the valve actuator generally perpendicular to the longitudinal axis of the second valve 34.

The condensate collector chamber 20 is preferably formed by an upper bell reducer 36 and a lower bell reducer 38 provided on the ends of a nipple 40. For example, the upper and lower bell reducers may be 1"×2" galvanized bell reducers provided on either end of a 2"×12" galvanized nipple. The upper valve 14 and the lower valve 34 preferably are 1" brass quarter turn ball valves with chrome plated brass balls.

In the preferred embodiment of FIG. 1, the lower valve 34 is provided with a first side port 41 provided on a side of the valve at the inlet of the valve 34. In this way, the first side port 41 is always in fluid communication with the inlet of the second valve whether the second valve is "open" or "closed." The first side port 41 receives a detector and alarm arrangement 44 through a union fitting 42 and a nipple 46. Preferably, the second valve 34 has a second side port 48 provided on the side of the second valve 34 opposite the first side port 41. In this way, during installation, the detector and alarm arrangement 44 may be positioned on either side of the condensate collector arrangement 10, as desired or as convenient, to provide ready access to the detector and alarm arrangement. If a side port 41, 48 is provided but is not being used to communicate with a sensor or other mechanism such as a float to detect the presence of condensate or water in the condensate collector, the side port is preferably closed by a threaded cap 49 to prevent an inadvertent loss of pressure in the dry pipe sprinkler system.

The detector and alarm arrangement 44 preferably contains a suitable, conventional device, such as a sensor or float mechanism, to detect the presence of condensate or water. When the device detects the presence of water, the device provides a signal to an alarm which may comprise a buzzer or other warning sound provided by a speaker 50. In a preferred embodiment, the sound alarm is a 103 dB beeping alarm. If desired, the alarm may also comprise a visual signal such as a light 52, for example, a red LED visual indicator. The alarms are preferably configured to provide intermittent or continuous alarms for 72 hours or more. A test button 54 may be provided for the sensor and alarm arrangement to determine whether the buzzer and/or the light are in an operational state.

As noted above, the presence of condensate or water may be detected by a float or any other suitable, conventional device. In the preferred embodiment, the presence of condensate or water is detected at the lower portion of the condensate collector, preferably through the side port provided in the inlet of the lower valve 34. In this way, the presence of even a relatively small amount of condensate may be detected to enable the condensate collector to be promptly emptied whenever at least a predetermined amount of condensate has been collected. When the condensate collector is subject to freezing temperatures, it is preferable to promptly drain the condensate out of the condensate collector in order to prevent the possibility of damage from frozen condensate or the possibility that the alarm and sensor may be deactivated by the frozen condensate.

With continued reference to FIG. 1, the condensate collector has a device 56 which physically prevents the first valve 14 and the second valve 34 from being open at the same time. In the preferred embodiment of FIG. 1, the device 56 comprises a plate 58 with four slots 60. A pair of U-bolts 62 (see also FIG. 2) are provided about the nipple 40 with the ends of the U-bolts extending slightly beyond the front of the nipple 40. Each of the U-bolts 62 has a saddle bracket 64 which is configured to snugly engage the nipple 40 and to provide a flat surface on the front portion of the condensate collector. The plate 58 is carried by the pair of U-bolts 62 by positioning the four slots 60 about the ends of the U-bolts 62 and then providing fasteners 66 such as threaded nuts at the ends of the U-bolts 62. In this way the plate 58 is retained by the slots between the saddle brackets 64 and the fasteners 66 for sliding movement longitudinally with respect to the condensate collector.

As shown in FIGS. 1-4, the threaded ends of the U-bolts 62 may be positioned above the nipple 40 (rather than alongside the outermost portion of the nipple 40). The U-bolts may be bent or formed so as to have a shape which encircles more than 180° of the nipple 40 in order to facilitate the use of a plate 58 that is only slightly wider than the nipple 40 (as shown). If it is desired to use conventional U-bolts that only encircle 180° of the nipple 40, the plate 58 would generally be widened so as to permit the slots 60 to be located at the sides of the nipple 40 rather than above the nipple 40.

In addition, it may be preferable to use threaded nuts 64 (see FIG. 8) to fix the bracket 64 against the nipple 40. In this way, the nuts 64 would cause the plate 58 to be spaced further away from the nipple 40. The nuts 64 are preferably locking nuts so that the plate 58 may be somewhat loosely held between the nuts 64 and the fasteners 66. In addition, plastic and/or metal spacers and washers may be used above and below the plate 58 as appropriate to facilitate the easy movement of the plate 58 between the first and second positions.

With reference again to FIG. 2, the plate 58 preferably has a first abutment portion 68 provided at an upper portion 70 of the plate. The first abutment portion 68 is preferably formed by a bend in the plate 58 to provide a horizontal surface when the middle portion of the plate 58 is oriented vertically. In other words, the first abutment portion extends perpendicularly to the middle portion of the plate 58. The plate 58 is also bent at the rear of the first abutment portion 68 again at a right angle to provide the upper portion 70 for the plate 58. The upper portion 70 has a slot 72 which is configured to be received by the upper valve 14 behind the valve actuator 22.

In the preferred embodiment, the plate 58 also has a second abutment portion 74 provided at a lower portion 76 of the plate. The second abutment portion 74 (see FIG. 2) is preferably formed by a second bend in the plate 58 to provide a horizontal surface when the middle portion of the plate 58 is oriented vertically. In other words, the second abutment portion extends perpendicularly to the middle portion of the plate 58. The plate 58 is also bent at the rear of the second abutment portion 74 again at a right angle to provide the lower portion 76 for the plate 58. The lower portion 76 has a slot 78 which is configured to be received by the lower valve 34 behind the valve actuator 30.

The upper and lower abutment portions 68, 74 preferably have a length corresponding to the distance between the relatively flat portion of the saddle brackets 64 and the lowermost portion of the valve actuators 22, 30. Similarly, the slots 60, 72, 78 preferably have a length along the plate corresponding to the distance from the axis 24, 32 of the valves to the end of the respective valve actuator. In a preferred embodiment, the axis of rotation of the valve actuators are set apart a predetermined distance so that the plate physically prevents the upper and lower valves from both being open at the same time.

In this way, the plate 58 is carried by the two U-bolts 62 and by the upper and lower valves 14, 34. The plate 58 mechanically links the two valves 14, 34 and the abutment portions prevent both valves from being fully open at the same time. The plate 58 mechanically links the two valves 14, 34 because the plate 58 is retained by the respective valve actuators 22, 30 to be movable between the first and second positions.

In the preferred embodiment, the plate 58 is powder coated safety red for corrosion resistance and is silk-screened with appropriate legends such as "AUXILIARY DRAIN" and appropriate operating instructions.

In the preferred embodiment, the fasteners 66, for example, locking nuts or cap nuts, do not press the plate 58 tightly against the saddle brackets 64. Instead, the plate 58 is slidably carried on the U-bolts 62 for movement between a first position when the second valve 34 is in the fully closed position. When the plate 58 is in the first position, the lower abutment portion 74 is located adjacent the valve actuator 30 of the second valve and prevents the valve actuator 30 from moving to the fully open position. In the preferred embodiment, the plate 58 and the abutment portions are configured so that the second valve 34 must remain in the fully closed position until the plate 58 is moved out of the first position.

While the plate 58 is in the first position, the first abutment portion 68 does not obstruct movement of the valve actuator 22 of the upper valve 14. Accordingly, the upper valve 14 may be fully open, fully closed or any position in between fully open and fully closed when the plate 58 is in the first position.

Figure 2:
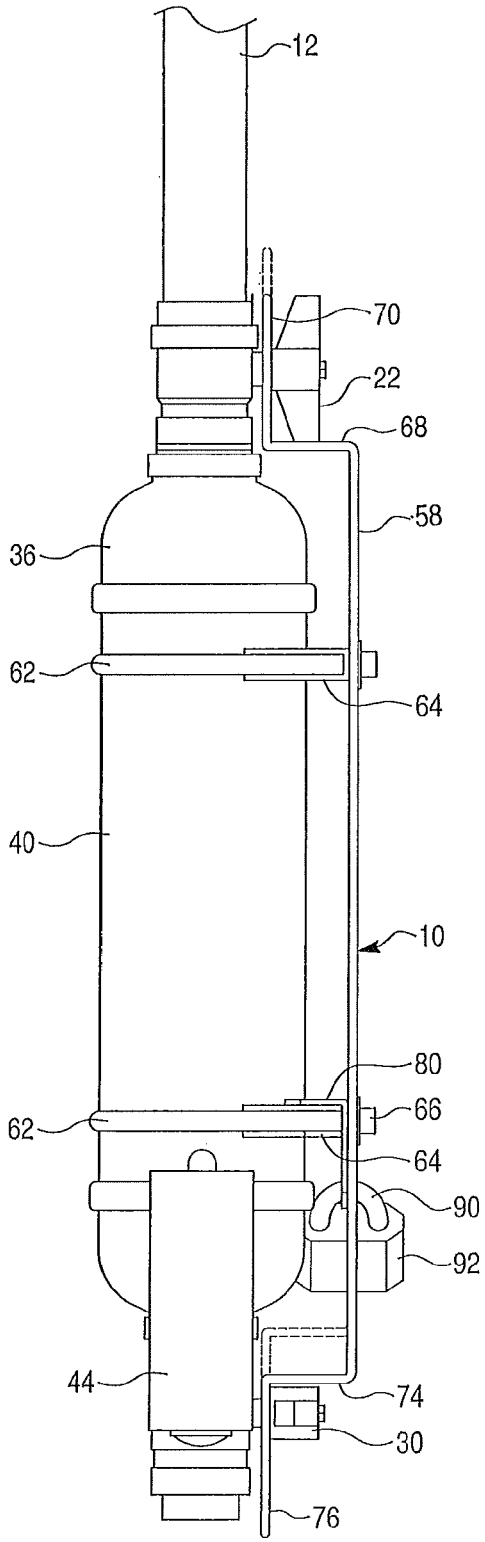
FIG. 2 is a side view of the condensate collector arrangement of FIG. 1.
Figure 7:
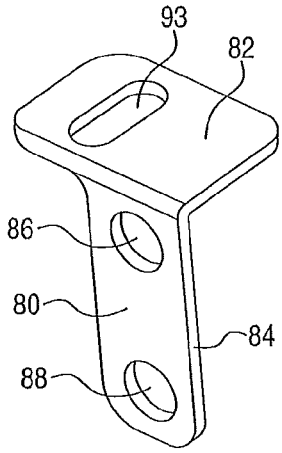
FIG. 7 is a perspective view of a bracket for use with the condensate collector of FIG. 1.

In a preferred embodiment, a locking bracket 80 is provided between the plate 58 and one of the saddle brackets 64 (see FIG. 2). The locking bracket 80 (see also FIG. 7) has an upper portion 82 which is oriented perpendicular to a lower portion 84. The lower portion 84 has a first hole 86 which is positioned over an end of one of the U-bolts 62 during assembly. The lower portion extends downwardly with respect to the saddle bracket with a second hole 88 positioned so as to be aligned with the lower portion of the slot 60 which engages the end of the U-bolt 62 when the plate 58 is in the first position. The second hole 88 is sized so as to permit a shackle 90 of a lock 92 to be received by the slot 60 and the second hole 88 when the plate 58 is in the first position. In this way, the locking bracket 80 and the lock 92 provide an arrangement in which the plate 58 may be prevented from being moved from the first position to the second position by an unauthorized person. Accordingly, the locking bracket 80 and the lock 92 are intended to prevent the unauthorized opening of the lower valve 34 while the upper valve 14 may be open.

Figure 8:
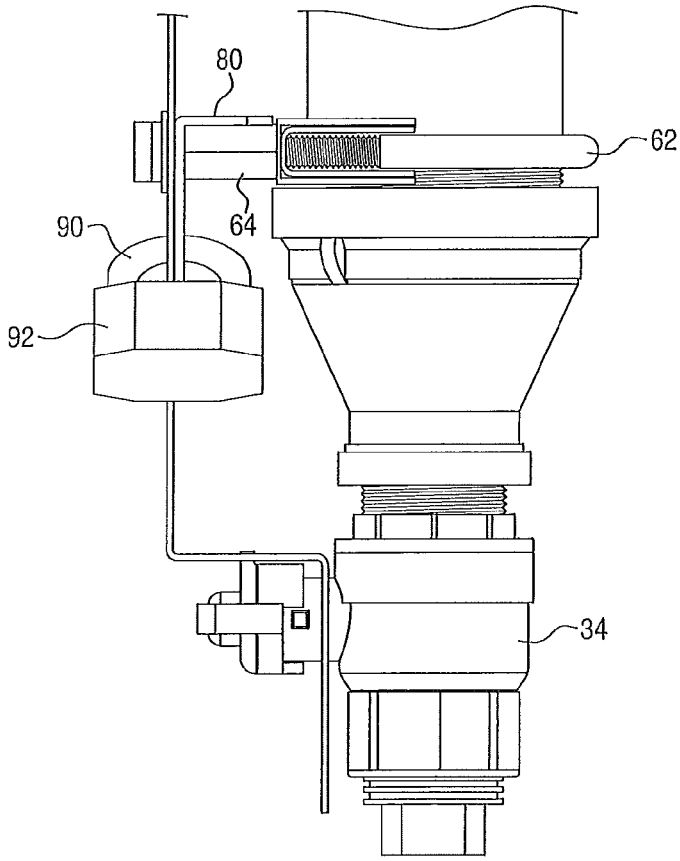
FIG. 8 is a side view of another embodiment of the lower portion of the condensate collector of FIG. 1.

The locking bracket 80 may also have a third hole 93 provided in the upper portion 82 of the locking bracket. If desired, a screw or other fastener (not shown) may be passed through the third hole 93 to secure the locking bracket 80 to the saddle bracket 64 although it is generally not necessary to attach the locking bracket 80 to the saddle bracket 64. With reference also to FIG. 8, the locking bracket is preferably provided at the lower U-bolt 62 adjacent the lower valve 34. If desired, the locking bracket 80 may be omitted and the shackle 90 of a lock 92 may be passed through the lower portion of one of the slots 60 when the plate 58 is in the first position. This arrangement would prevent the plate 58 from being moved into the second position until the shackle of the lock were removed because the slot is preferably sized so as to require the bottom of the slot to be against the U-bolt 62 when the plate 58 is in the second position. However, the locking bracket 80 provides a more reliable and tamper resistant configuration for preventing an unauthorized movement of the plate 58 out of the first position.

Figure 3:
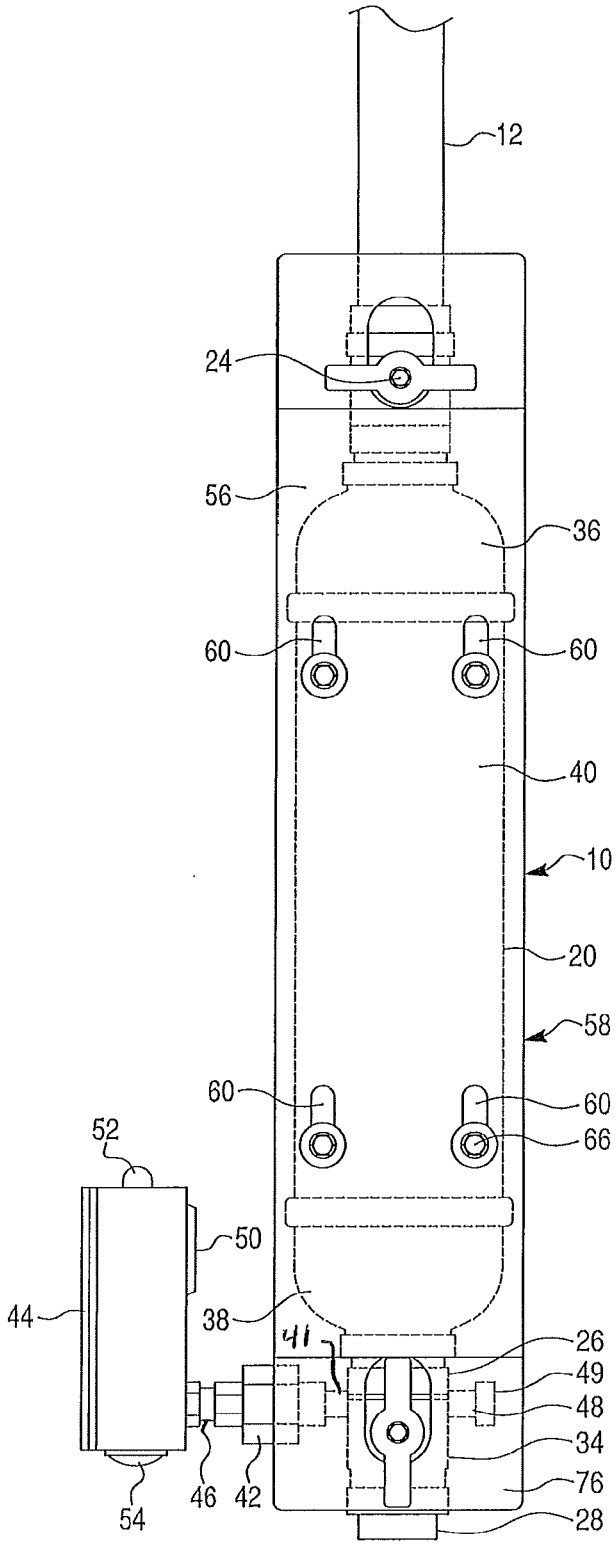
FIG. 3 is a front view of the condensate collector arrangement of FIG. 1 with the anti-trip arrangement in a second position.
Figure 4:
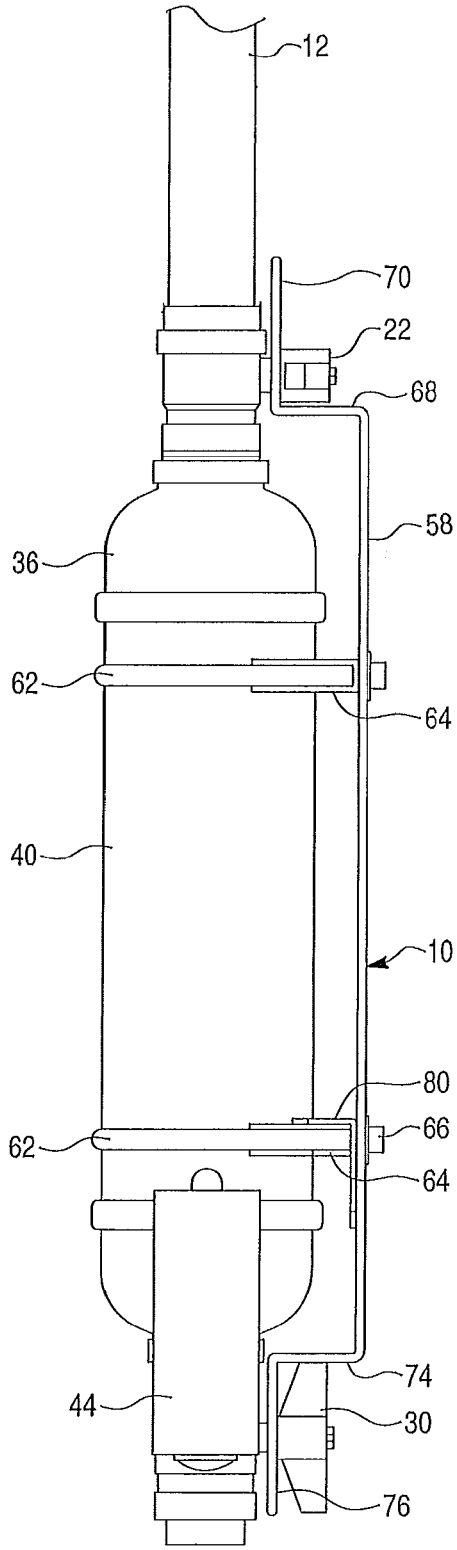
FIG. 4 is a side view of the condensate collector arrangement of FIG. 3.

With reference now to FIGS. 3 and 4, the plate 58 may be moved to the second position when the valve actuator 22 of the first valve 14 is in the fully closed position. If the condensate collector has been provided with a lock 92, the lock must first be removed so that the shackle 90 of the lock does not prevent movement of the plate to the second position.

When the plate 58 is in the second position, the upper or first valve 14 must be closed and the valve actuator 30 of the lower or second valve 34 may be freely moved between the fully open and fully closed positions.

Figure 5:
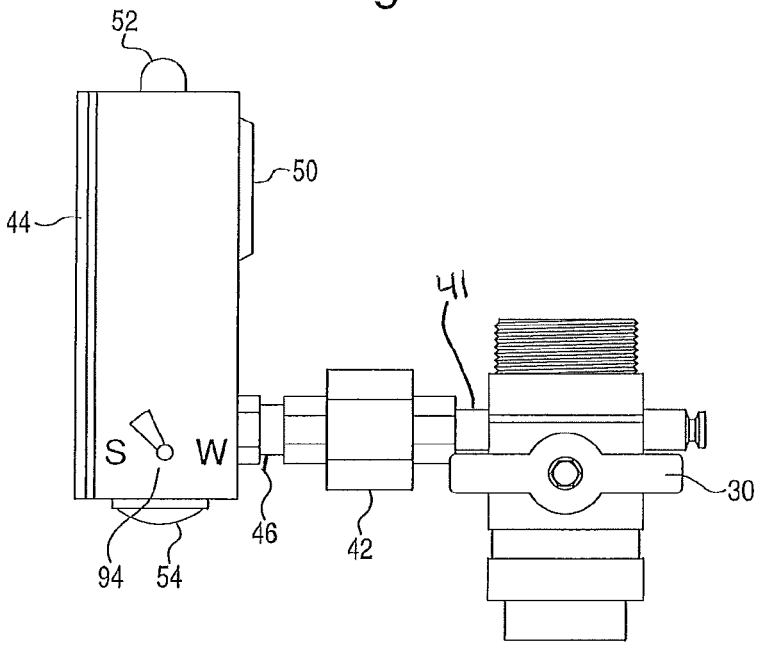
FIG. 5 is a front view of another embodiment of a lower portion of the condensate collector of FIG. 1.

With reference now to FIG. 5, the detector and alarm arrangement 44 may be provided with a switch 94. The switch 94 may be provided at a conveniently accessible location on the sensor and alarm arrangement 44, such as on a side of a housing for the device. The switch preferably has an "on" position in which the alarm is active and an "off" position in which the alarm is inactive. The positions of the switch 94 may be designated as "S" or "summer" and "W" or "winter" to indicate that the switch 94 should be in the "on" position during the winter season and in the "off" position during the summer season.

Because the detector and alarm arrangement 44 are preferably positioned in fluid communication with the inlet of the lower valve 34, the sensor (or float if the presence of condensate or water is detected by a float mechanism) will detect a relatively small amount of condensate in the condensate collector. In this way, the condensate collector may be serviced to drain the condensate collector whenever a predetermined amount of condensate which is sufficient to activate the sensor or to trigger the float mechanism has accumulated in the condensate collector. This procedure may be desirable in winter months since condensate may then be drained promptly upon collection and avoid having the condensate freeze and potentially impact either the condensate collector or other aspects of the dry pipe sprinkler system.

In the summer or during periods that are not susceptible to freezing temperatures, having the alarm sound whenever a relatively small amount of condensate has accumulated in the condensate collector at the lower valve 34 may be undesirable and provide an annoyance. Accordingly, to prevent frequent and undesirable alarms, for example, during summer months, the detector and alarm arrangement 44 may be deactivated by moving the switch 94 to the "summer" position.

Figure 6:
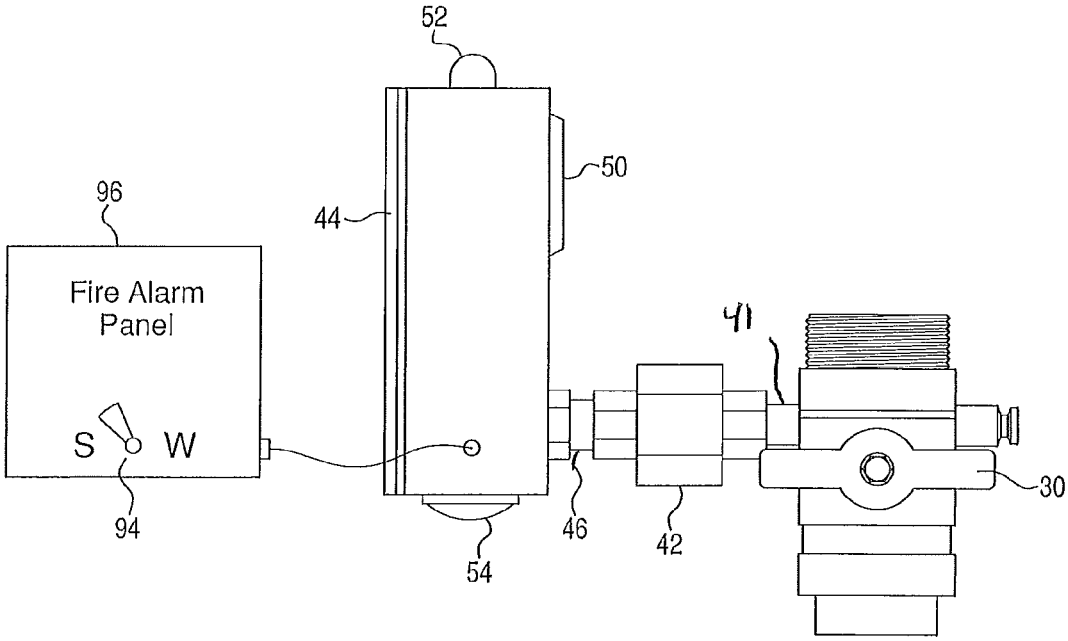
FIG. 6 is a front view of another embodiment of the lower portion of the condensate collector of FIG. 1.

With reference now to FIG. 6, the detector and alarm arrangement 44 may be connected electrically to a remote indication panel such as an auxiliary indication panel or a fire alarm panel 96 so that the presence of a predetermined amount of condensate in the condensate collector is indicated at the remote fire alarm panel 96. The condensate collector may be configured so that an alarm, either by a light or by sound or by any other suitable conventional signal, is provided at the remote fire alarm panel 96. In this situation, it may be desirable to omit any alarm at the condensate collector and to only provide the alarm at the remote fire alarm panel 96. Whether an alarm is provided at the condensate collector or not, it may be preferable to provide the switch 94 at the remote fire alarm panel 96 either to selectively deactivate the alarm at the condensate collector or to selectively deactivate the alarm at the remote fire protection panel or to selectively deactivate both alarms (if provided).

In operation, the condensate collector arrangement or drum drip 10 typically has the first or upper valve 14 placed in an open configuration and the lower or drain valve 34 is in a closed configuration. In this initial condition, such as may occur immediately after initial installation of the dry pipe sprinkler system or after the condensate collector 10 has been emptied, the condensate collector 10 has no condensate. In this initial configuration, the anti-trip arrangement prevents the lower valve from being fully open. Preferably, the plate 58 abuts the valve actuator of the lower valve 34 to maintain the lower valve in the fully closed position until and unless the upper valve has been fully closed.

As the ambient temperature drops, condensate begins to fill the condensate collector. At this point, the sensor and alarm arrangement 44 may emit an audible and/or visual signal indicating the presence of a predetermined amount of condensate. The condensate collector arrangement or the drum drip 10 is then drained of condensate by first closing the upper valve 14 (to prevent the release of pressurized gas from pipes when condensate is removed from the drum drip 10) and then the anti-trip arrangement is repositioned to permit the lower or drain valve 34 to be opened.

In the preferred embodiment, the sensor and alarm arrangement is battery powered such as by a 9-volt alkaline battery which is mounted in an enclosure or housing for the alarm and sensor. Alternatively, the alkaline battery may be replaced with hard wired lithium batteries (not shown) which have relatively long life operation down to temperatures of about −40° F. An on-off switch could be supplied so that the batteries are not drained during storage and shipment prior to installation. Also, a piezo style buzzer may be used to facilitate long battery life. With regard to FIG. 6, the detector and the alarm (if provided) may be powered through the auxiliary alarm panel rather than by way of a 9-volt battery, as desired.

If desired, a locking ball valve (not shown) may be used as the lower or drain valve in any of the embodiments of the condensate collector arrangement. The locking ball valve has a lock provided on the valve member actuator which prevents movement of the valve member unless a key is used in the lock. In this way, an unintentional or unauthorized opening of the drain valve in the condensate collector arrangement may be avoided or prevented. However, even the locking ball valve as the lower or drain valve does not prevent the inadvertent opening of the upper valve while the lower or drain valve is still open. Accordingly, the use of a locking ball valve as the lower or drain valve does not provide a reliable anti-trip arrangement to prevent an inadvertent tripping of the dry pipe sprinkler system by having the upper valve and the lower valve open at the same time.

The principles, preferred embodiments and mode of operation of the present invention have been described in the foregoing specification. However, the invention which is intended to be protected is not to be construed as limited to the particular embodiments disclosed. The embodiments are therefore to be regarded as illustrative rather than as restrictive. Variations and changes may be made without departing from the spirit of the present invention. Accordingly, it is expressly intended that all such equivalents, variations and changes which fall within the spirit and scope of the present invention as defined in the claims be embraced thereby.

The invention claimed is:

1. A condensate collector for a dry pipe sprinkler system, comprising:

a first valve comprising an inlet and an outlet, said first valve selectively being open or closed, said first valve when open permitting communication between the inlet and the outlet of the first valve and said first valve when closed preventing communication between the inlet and the outlet of the first valve;

a second valve comprising an inlet and an outlet, said second valve selectively being open or closed, said second valve when open permitting communication between the inlet and the outlet of the second valve and said second valve when closed preventing communication between the inlet and the outlet of the second valve;

a collection chamber in fluid communication with the outlet of said first valve and the inlet of the second valve; and, an anti-trip arrangement for physically preventing the first valve and the second valve from being fully open at the same time, the anti-trip arrangement mechanically linking the first valve and the second valve to prevent the first valve and the second valve from being fully open at the same time.

2. The condensate collector arrangement of claim 1, wherein the anti-trip arrangement comprises a plate member which is movable to a first position wherein the first valve may be fully open and the second valve must be closed.

3. The condensate collector arrangement of claim 2, wherein said first and second valves are quarter-turn valves and wherein said first valve further comprises a first valve actuator and wherein said second valve further comprises a second valve actuator, said first valve actuator comprises a first axis of rotation, said second valve actuator comprises a second axis of rotation, and said first axis of rotation and said second axis of rotation are oriented in the same general direction with respect to the collection chamber, said first and second axis of rotation being separated from each other in the condensate collector by a predetermined distance.

4. The condensate collector arrangement of claim 2, wherein said first valve comprises a first valve actuator, said first valve actuator being moveable between a first position wherein the first valve is fully open and a second position wherein the first valve is fully closed and wherein said second valve comprises a second valve actuator, said second valve actuator being moveable between a first position wherein the second valve is fully open and a second position wherein the second valve is fully closed, said anti-trip arrangement preventing movement of said second valve actuator to said first position to fully open the second valve when said first valve actuator is in said first position.

5. The condensate collector arrangement of claim 4, wherein said anti-trip arrangement prevents movement of said first valve actuator to said first position to fully open the first valve when said second valve actuator is in said first position.

6. The condensate collector arrangement of claim 5, wherein said plate member comprises a first valve abutment portion which prevents movement of said first valve actuator to said first position when said plate is in said second position and wherein said plate member comprises a second valve abutment portion which prevents movement of said second valve actuator to said first position when said plate is in said first position.

7. The condensate collector arrangement of claim 6, wherein said collection chamber is generally elongate between said first valve and said second valve and wherein said collection chamber is generally cylindrical and wherein said first valve member and said second valve member are generally aligned with one another with said collection chamber extending longitudinally between said first valve member and said second valve member and wherein said first valve abutment portion prevents the plate from moving to the second position when the first valve actuator is in the first position and the second valve abutment portion prevents the plate from moving to the first position when the second valve actuator is in the first position.

8. The condensate collector arrangement of claim 7, wherein said plate is carried by said collection chamber for movement between said first and second positions.

9. The condensate collector arrangement of claim 8, wherein said plate is also carried by said first and second valves for movement between said first and second positions.

10. The condensate collector of claim 9 further comprising a lock which engages said plate to prevent movement of said plate from said first position to said second position when said lock engages said plate.

11. The condensate collector of claim 10 further comprising a bracket which includes an opening to selectively receive the lock when said plate is in said first position, said bracket and said lock together preventing movement of the plate to the second position independent of whether the first valve is open or closed.

12. The condensate collector arrangement of claim 9, wherein said plate comprises a middle section provided between said first valve abutment portion and said second valve abutment portion, said middle section being generally planar with at least one slot, said at least one slot limiting movement of said plate to movement between said first position and said second position.

13. The condensate collector arrangement of claim 12, wherein said first valve abutment portion extends generally perpendicular to said middle section of said plate and wherein said second valve abutment portion extends generally perpendicular to said middle section of said plate.

14. The condensate collector arrangement of claim 13, wherein said plate further comprises a first end portion which is slidably received by said first valve and a second end portion which is slidably received by said second valve, said first end portion extending generally perpendicular to said first abutment portion and said second end portion extending generally perpendicular to said second abutment portion.

15. The condensate collector arrangement of claim 14, wherein said inlet of said second valve member further comprises first and second side ports, said first and second side ports being provided generally perpendicular to a longitudinal axis of said second valve, said first and second side ports being generally collinear and provided on opposite sides of said second valve.

16. The condensate collector arrangement of claim 15, further comprising an alarm for indicating the presence of at least a predetermined amount of liquid in said condensate collector.

17. The condensate collector of claim 16 wherein said alarm indicates the presence of a predetermined amount of liquid in the condensate collector adjacent the second valve.

18. The condensate collector of claim 16 wherein said alarm further comprises a switch to selectively disable the alarm.

19. The condensate collector arrangement of claim 14, wherein said inlet of said second valve member further comprises at least one side port, said inlet and said outlet of said first valve and said inlet and said outlet of said second valve being generally collinear.

20. The condensate collector of claim 19, further comprising a sensor in fluid communication with said collection chamber through said side port of said second valve, said sensor detecting the presence of said predetermined amount of liquid in the condensate collector adjacent the second valve.

21. The condensate collector arrangement of claim 1, wherein the anti-trip arrangement comprises a plate member which is movable to a second position wherein the second valve may be fully open and the first valve must be closed.

22. The condensate collector arrangement of claim 1 further comprising an alarm for indicating the presence of at least a predetermined amount of water in said condensate collector.

23. The condensate collector of claim 1 further comprising an arrangement for detecting the presence of at least a predetermined amount of water in said condensate collector, said arrangement being configured to provide a signal at an indication panel provided at a location remote from said condensate collector.

* * * * *